US009732470B2

(12) United States Patent
Yamazaki et al.

(10) Patent No.: US 9,732,470 B2
(45) Date of Patent: Aug. 15, 2017

(54) SHOE PRESS BELT FOR PAPERMAKING

(71) Applicant: ICHIKAWA CO., LTD., Bunkyo-ku (JP)

(72) Inventors: Shintaro Yamazaki, Bunkyo-ku (JP); Yuya Takamori, Bunkyo-ku (JP); Chie Umehara, Bunkyo-ku (JP); Mitsuyoshi Matsuno, Bunkyo-ku (JP); Nobuharu Suzuki, Bunkyo-ku (JP)

(73) Assignee: ICHIKAWA CO., LTD., Bunkyo-ku (JP)

( * ) Notice: Subject to any disclaimer, the term of this patent is extended or adjusted under 35 U.S.C. 154(b) by 0 days.

(21) Appl. No.: 14/897,175

(22) PCT Filed: Jun. 13, 2014

(86) PCT No.: PCT/JP2014/065787
§ 371 (c)(1),
(2) Date: Dec. 9, 2015

(87) PCT Pub. No.: WO2014/200095
PCT Pub. Date: Dec. 18, 2014

(65) Prior Publication Data

US 2016/0130755 A1 May 12, 2016

(30) Foreign Application Priority Data

Jun. 14, 2013 (JP) ..... 2013-138374

(51) Int. Cl.
*D21F 3/02* (2006.01)

(52) U.S. Cl.
CPC ..... *D21F 3/0227* (2013.01)

(58) Field of Classification Search
CPC .... D21F 3/0227; D21F 3/0236; D21F 1/0036; Y10S 162/901; Y10S 162/90;
(Continued)

(56) References Cited

U.S. PATENT DOCUMENTS 7,909,965 B2 * 3/2011 Yazaki ..... D21F 3/0227 162/358.4
7,922,869 B2 * 4/2011 Ishino ..... D21F 3/0227 162/358.4
(Continued)

FOREIGN PATENT DOCUMENTS

JP 2002 146694 5/2002
JP 2004-36015 A 2/2004
(Continued)

OTHER PUBLICATIONS

International Search Report Issued Sep. 9, 2014 in PCT/JP2014/065787 Filed Jun. 13, 2014.

*Primary Examiner* — Jose Fortuna
(74) *Attorney, Agent, or Firm* — Oblon, McClelland, Maier & Neustadt, L.L.P.

(57) ABSTRACT

The purpose of the present invention is to provide a shoe press belt which exhibits improvement in mechanical characteristics such as crack resistance, wear resistance, delamination resistance and bending fatigue resistance, particularly in the surface wear resistance of the shoe press belt and the crack resistance of the bottom regions of water receiving parts. A shoe press belt which is produced by integrating a reinforcing substrate with a polyurethane layer including at least a felt-side layer and in which water-receiving parts are formed in the felt-side layer, wherein the polyurethane equivalent value of the second resin layer including the bottom regions of the water-receiving parts is adjusted so as to be larger than that of the first resin layer including a surface which is to be brought into contact with a felt.

7 Claims, 2 Drawing Sheets

(58) Field of Classification Search
CPC ..... Y10T 428/24355; Y10T 428/24942; Y10T 428/2457; Y10T 428/26; Y10T 442/20; Y10T 442/2344; Y10T 442/2098; Y10T 442/2066; Y10T 442/2041; Y10T 442/30; C08G 18/09; C08G 18/10
See application file for complete search history.

(56) References Cited

U.S. PATENT DOCUMENTS 7,943,013 B2 * 5/2011 Yazaki ..... C08G 18/10 162/358.1
7,947,154 B2 * 5/2011 Yazaki ..... C08G 18/10 162/358.4
7,955,475 B2 * 6/2011 Yazaki ..... D21F 3/0227 162/358.4
8,137,507 B2 * 3/2012 Ishino ..... D21F 3/0227 162/358.2
8,449,723 B2 * 5/2013 Yamazaki ..... D21F 3/0227 162/358.4
2004/0014383 A1 1/2004 Ishino
2004/0029474 A1 2/2004 Watanabe et al.
2004/0065427 A1 4/2004 Kimura
2006/0201649 A1 9/2006 Hikida
2009/0038770 A1 2/2009 Ishii
2010/0147480 A1 * 6/2010 Yazaki ..... D21F 3/0227 162/358.4
2010/0186918 A1 * 7/2010 Ishino ..... D21F 3/0227 162/289
2010/0186920 A1 * 7/2010 Yazaki ..... C08G 18/10 162/358.1
2010/0314067 A1 * 12/2010 Yazaki ..... C08G 18/10 162/358.2
2011/0017419 A1 * 1/2011 Yazaki ..... D21F 3/0227 162/289
2011/0303383 A1 * 12/2011 Yamazaki ..... D21F 3/0227 162/358.4
2013/0192787 A1 * 8/2013 Yazaki ..... D21F 3/0227 162/358.4
2013/0192788 A1 * 8/2013 Yazaki ..... D21F 3/0227 162/358.4
2016/0130755 A1 * 5/2016 Yamazaki ..... D21F 3/0227 162/289
2016/0208437 A1 * 7/2016 Umehara ..... D21F 1/0036
2016/0348311 A1 * 12/2016 Inoue ..... D21F 7/086
2016/0355978 A1 * 12/2016 Takamori ..... D21F 3/029
2017/0051455 A1 * 2/2017 Sugawara ..... D21F 2/00

FOREIGN PATENT DOCUMENTS

JP 2004 52204 2/2004
JP 2005 120571 5/2005
JP 2006 225839 8/2006
JP 2007 204862 8/2007
JP EP 2157233 A1 * 2/2010 ..... D21F 3/0227
JP EP 2169112 A1 * 3/2010 ..... C08G 18/10
JP EP 2169113 A1 * 3/2010 ..... D21F 3/0227
JP 2010-196205 A 9/2010
JP WO 2010098106 A1 * 9/2010 ..... D21F 3/0227
JP EP 2248944 A1 * 11/2010 ..... C08G 18/10
WO 2005 014927 2/2005

* cited by examiner

SHOE PRESS BELT FOR PAPERMAKING

TECHNICAL FIELD

The present invention relates to a papermaking shoe press belt (hereinafter also referred to as shoe press belt) for use in a papermaking shoe press device and more particularly relates to the improvement of the thermosetting polyurethane resin layer of a shoe press belt.

DESCRIPTION OF THE RELATED ART

A papermaking shoe press device 1, as shown in FIG. 5, uses a shoe press mechanism in which a loop-shaped shoe press belt 3 is interposed between a press roll 2 and a shoe 6; wherein dewatering is performed by passing a felt 4 and a wet paper web 5 through a press section formed by the press roll 2 and the shoe 6.

Moreover, as shown in FIG. 4, the shoe press belt 3, wherein a reinforcing base material 16 and a thermosetting polyurethane 22 are integrated, is made so that water receiving parts (water discharge grooves in FIG. 4) are formed in the depth direction from the felt side layer surface for receiving the water squeezed under the press from the wet paper web 5 and the felt 4; wherein the water squeezed from the wet paper web 5 and the felt 4 during the pressing is held in the water receiving parts 17 and the held water is discharged to the outside of the press section by the rotation of the shoe press belt. Consequently, it is desirable to improve the mechanical properties of the shoe press belt 3 such as crack resistance, flexural fatigue resistance, wear resistance, delamination resistance, and the like, against flexural fatigue, friction of the shoe press belt in the shoe press region and vertical pressing forces from the press roll 2 and the shoe 6.

For the above reasons, various improvements have been proposed for the resin material forming the thermosetting polyurethane of the shoe press belt 3.

For example, papermaking belts have been proposed wherein a reinforcing base material and a thermosetting polyurethane are integrated, the reinforcing base material is embedded in the polyurethane, and an outer circumferential surface and an inner circumferential surface are made of the polyurethane; wherein the polyurethane constituting the outer circumferential surface is formed from a composition comprising a urethane prepolymer having a terminal isocyanate group and a curing agent having a terminal active hydrogen group, wherein the composition is made by mixing the urethane prepolymer and the curing agent so that the equivalent ratio (H/NCO) of the active hydrogen group (H) of the curing agent to the isocyanate group (NCO) of the urethane prepolymer is a value of $1<H/NCO<1.15$ (refer to Patent Documents 1, 2 and 3: JP-A-2002-146694, JP-A-2005-120571, and JP-A-2006-225839, respectively).

Moreover, papermaking belts have been proposed wherein a reinforcing base material and a thermosetting polyurethane are integrated, the reinforcing base material is embedded in the polyurethane, the polyurethane comprises an inner polyurethane and an outer polyurethane contacting the outer circumferential surface of the inner polyurethane; wherein the inner polyurethane and the outer polyurethane are each formed from compositions comprising a urethane prepolymer having a terminal isocyanate group and a curing agent having a terminal active hydrogen group, the composition forming the inner polyurethane is made by mixing the urethane prepolymer and the curing agent so that the equivalent ratio (H/NCO) of the hydrogen group (H) of the curing agent to the isocyanate group (NCO) of the urethane prepolymer is a value in the range of $0.85\leq H/NCO<1$, the composition forming the outer polyurethane is made by mixing the urethane prepolymer and the curing agent so that the equivalent ratio (H/NCO) is a value in the range of $1<H/NCO<1.15$ (refer to Patent Documents 1, 2 and 3).

Furthermore, belts for papermaking machines have been proposed which are made from a substrate and polyurethane; wherein the polyurethane comprises a urethane prepolymer having a terminal isocyanate group and a curing agent comprising dimethylthiotoluenediamine, and the equivalent ratio of the active group of the curing agent to the isocyanate group of the urethane prepolymer is a value in the range of 0.9 to 1.10 (refer to Patent Document 4: JP-A-2004-52204).

PRIOR ART DOCUMENTS

Patent Documents

Patent Document 1: JP-A-2002-146694
Patent Document 2: JP-A-2005-120571
Patent Document 3: JP-A-2006-225839
Patent Document 4: JP-A-2004-52204

In the papermaking belts according to Patent Documents 1 thru 3, the polyurethane constituting the outer circumferential surface is formed from a composition comprising a urethane prepolymer having a terminal isocyanate group and a curing agent having a terminal active hydrogen group, wherein the composition is made by mixing the urethane prepolymer and the curing agent so that the equivalent ratio (H/NCO) of the active hydrogen group (H) of the curing agent to the isocyanate group (NCO) of the urethane prepolymer is a value in the range of $1<H/NCO<1.15$; thereby, even if cracks do appear in a papermaking belt, the growth of these cracks is to be inhibited.

Moreover, the composition forming the inner polyurethane is made by mixing the urethane prepolymer and the curing agent so that the equivalent ratio (H/NCO) of the hydrogen group (H) of the curing agent to the isocyanate group (NCO) of the urethane prepolymer is in the range of $0.85\leq H/NCO<1$, and the composition forming the outer polyurethane is made by mixing the urethane prepolymer and the curing agent so that the equivalent ratio (H/NCO) is a value in the range of $1<H/NCO<1.15$; thereby, delamination between the reinforcing base material and the polyurethane is to be suppressed.

On the other hand, wear resistance is also an important function required in the outer circumferential surface of a papermaking shoe press belt, and, even though crack resistance is excellent in a papermaking belt according to Patent Documents 1 thru 3 in which the equivalent ratio (H/NCO) is in the range of $1<H/NCO<1.15$, wear resistance is inferior.

In recent years, together with the increase in operation speed, the increase in pressure of the press part, and the like, for improving the productivity of papermaking, the operating environment of a shoe press belt has become increasingly severe; thus, papermaking shoe press belts having crack resistance and crack propagation resistance together with wear resistance are required.

SUMMARY OF THE INVENTION

Problems to be Solved by the Invention

The object of the present invention is to provide a shoe press belt having improved mechanical properties such as crack resistance, wear resistance, delamination resistance and flexural fatigue resistance; wherein, in particular, the wear resistance of the shoe press belt surface and the crack resistance at the bottom part regions of the water receiving parts are improved.

Means for Solving the Problems of the Invention

The present invention, in order to solve the above problems, improves the thermosetting polyurethane resin layer of a shoe press belt and is specifically based on the technology described hereinafter.

(1) A papermaking shoe press belt in which a reinforcing base material is integrated with thermosetting polyurethane comprised in at least a felt-side layer, and in which, in the felt-side layer, water receiving parts are formed in the depth direction from the felt-side surface for receiving water squeezed from a wet paper web and a felt under a nip; wherein the felt-side layer comprises at least a first resin layer having a felt contacting surface and a second resin layer having bottom part regions of the water receiving parts, the first and the second resin layers are formed from a composition comprising a urethane prepolymer having a terminal isocyanate group and a curing agent having a terminal active hydrogen group, the value of the equivalent ratio (H/NCO) of the active hydrogen group (H) of the curing agent to the isocyanate group (NCO) of the urethane prepolymer is higher in the second resin layer than in the first resin layer.

(2) The papermaking shoe press belt according to (1); wherein the water receiving parts are water discharge grooves.

(3) The papermaking shoe press belt according to any one of (1) to (2); wherein the difference between the equivalent ratio of the first resin layer and the equivalent ratio of the second resin layer is 0.02 or more.

(4) The papermaking shoe press belt according to any one of (1) to (3); wherein the difference between the equivalent ratio of the first resin layer and the equivalent ratio of the second resin layer is 0.04 or more.

(5) The papermaking shoe press belt according to any one of (1) to (4); wherein the equivalent ratio (H/NCO) of thermosetting polyurethane of the first resin layer is a value between 0.80 and 1.15.

(6) The papermaking shoe press belt according to any one of (1) to (5); wherein the equivalent ratio (H/NCO) of the thermosetting polyurethane of the first resin layer is a value between 0.80 and 0.99.

(7) The papermaking shoe press belt according to any one of (1) to (6); wherein the interface between the second resin layer and the resin layer adjacent to the second resin layer represents 10% or more of the depth of the water receiving parts from the bottom part of the water receiving part section.

(8) The papermaking shoe press belt according to any one of (1) to (7); wherein the urethane prepolymer and the curing agent of the first resin layer and the second resin layer are made from the same material.

Advantages of the Invention

According to the shoe press belt of the present invention, by setting the equivalent ratio of the polyurethane of the second resin layer comprising water receiving parts at a higher value than the equivalent ratio of the polyurethane of the first resin layer comprising a felt contacting surface, it is possible to avoid the wear phenomenon of the felt contacting surface of the first resin layer, while suppressing the occurrence and growth of cracks from the corner parts and bottom parts of the water receiving parts, thereby remarkably improving the durability of the shoe press belt.

Moreover, by setting the equivalent ratios of adjacent resin layers at higher and lower values with the value 1 as the boundary, for example, by setting the equivalent ratio of the first resin layer at a value of 1 or less and the equivalent ratio of the second resin layer at a value of more than 1, the adhesion of the first resin layer to the second resin layer is strengthened and delamination of the layers can be prevented by the strong bond between the excess active hydrogen groups (H) of the second resin layer and the excess isocyanate groups (H/NCO) of the first resin layer.

BEST MODES FOR CARRYING OUT THE INVENTION

Figure 1:
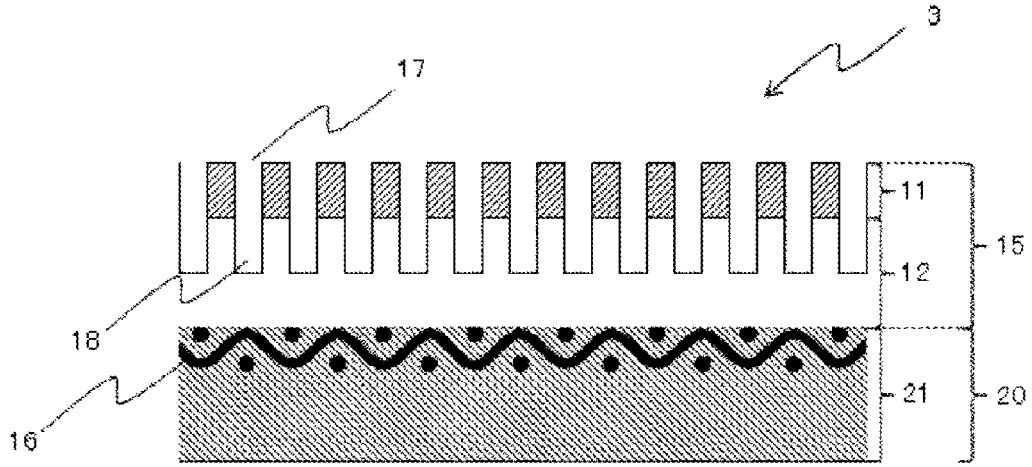
FIG. 1 is a partial cross-sectional view showing one example of a papermaking shoe press belt according to the present invention.

Hereinafter, embodiments of the present invention will be described by referring to the drawings. FIG. 1 is a partial cross-sectional view showing one example of a papermaking shoe press belt 3 of the present invention.

Figure 5:
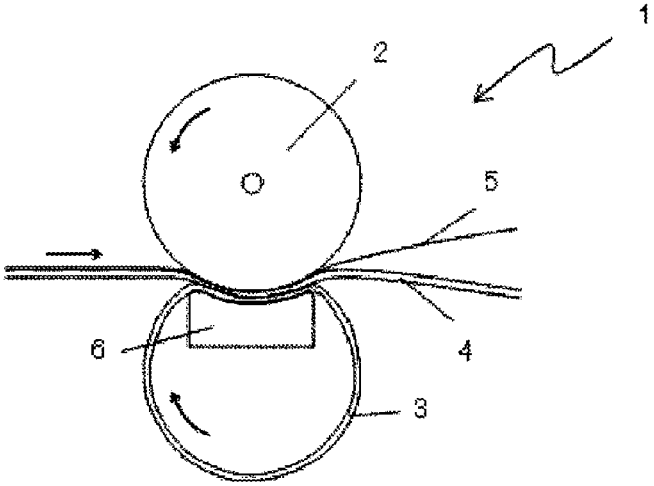
FIG. 5 is a schematic diagram of a papermaking shoe press device.

Shoe press belt 3 is an annular belt which forms an endless belt. Furthermore, the two main surfaces of the belt respectively form the outer and inner circumferential surface of the shoe press belt 3. During its use, the shoe is arranged at the side of the inner circumferential surface of the shoe press belt 3, while its outer circumferential surface side carries a felt 4, shown in FIG. 5.

The shoe press belt 3 is made by integrating a reinforcing base material 16 and a thermosetting polyurethane, wherein the reinforcing base material 16 is embedded in the polyurethane. The polyurethane provides a felt-side layer (outer circumferential layer) 15, wherein, in the felt-side layer 15, water receiving parts (water discharge grooves 17 in FIG. 1) for receiving water squeezed from a wet paper web and a felt under a nip are formed from the felt-side surface in the depth direction of the felt-side layer 15. Then, the felt-side layer 15 comprises a first resin layer 11 having a felt contacting surface (outer circumferential surface) and a second resin layer 12 having bottom part regions 18 of the water receiving parts 17. The polyurethane also provides a shoe-side layer (inner circumferential layer) 20, wherein the shoe-side layer 20 is formed from a shoe-side resin layer 21 having a shoe contacting surface (inner circumferential surface). In the shoe press belt 3 shown in FIG. 1, the reinforcing base material 16 is embedded in the shoe-side layer 20; however, the position where the reinforcing base material 16 is embedded is not particularly limited.

It is possible to use, for example, a woven fabric as reinforcing base material 16. Not only the woven fabrics described in Patent Documents 1 thru 4 but woven fabrics described in other documents can also be used. For example, it is also possible to use a grid-like web wherein warp and weft yarns of 5000 dtex multifilament twisted yarn of polyethylene terepththalate (PET) fibers are used and wherein the warp yarns are sandwiched by the weft yarns and the intersecting parts are joined by a polyurethane adhesive.

As fiber material used in the reinforcing base material 16, aramide fibers, polyamide fibers of nylon 6.6, nylon 6.10, nylon 6, and the like, may also be used instead of polyethylene terephthalate. Moreover, it is also possible to use fibers of different materials in the warp yarns and in the weft yarns, or to use fibers of different thickness, such as 5000 dtex and 7000 dtex, and the like, in the warp and weft yarns.

The shoe-side layer 20 and the felt-side layer 15 having the first resin layer 11 and the second resin layer 12 are formed from polyurethane; in other words, said layers are formed from a composition comprising a urethane prepolymer having a terminal isocyanate group (NCO) and a curing agent having a terminal active hydrogen group (H). The layers are laminated so that the value of the equivalent ratio (H/NCO, the equivalent ratio based on the stoichiometric amount) of the active hydrogen group (H) to the isocyanate group (NCO) is higher in the second resin layer 12 than in the first resin layer 11.

Furthermore, the equivalent ratio of the second resin layer 12 is preferably higher than the equivalent ratio of the first resin layer 11; wherein the difference between the equivalent ratio in the first resin layer 11 and the second resin layer 12 is preferably 0.02 or more, still more preferably 0.04 or more and even more preferably 0.1 or more.

Moreover, the equivalent ratio of the first resin layer is not particularly limited; however, for example, a value of 0.80 to 1.15 is preferable, a value of 0.8 to 1.0 is even more preferable, and a value of 0.80 to 0.99 is still more preferable. This makes it possible to more reliably suppress the occurrence of wear on the felt-side surface. Furthermore, the equivalent ratio of the second resin layer is not particularly limited; however, for example, a value of 0.9 or more is preferable, a value of 0.95 to 1.15 is even more preferable. This makes it possible to more reliably suppress the occurrence of cracks in the bottom part regions 18 of the water receiving parts.

Examples of phenylene isocyanate derivatives for obtaining the urethane prepolymer having a terminal isocyanate group (NCO) include, for example, tolylene diisocyanate (TDI), diphenylmethane diisocyanate (MDI), p-phenylene diisocyanate (PPDI), m-xylene diisocyanate (m-XDI), naphthalene diisocyanate (NDI), and the like. These derivatives may be used alone, or two or more may be mixed.

Of the above derivatives, preferred examples of phenylene isocyanate derivatives used for forming the first resin layer 11 are tolylene diisocyanate (TDI), diphenylmethane diisocyanate (MDI) and p-phenylene diisocyanate (PPDI). This makes it possible to more reliably suppress the occurrence of wear on the felt-side surface.

Moreover, of the above derivatives, preferred examples of phenylene isocyanate derivatives used for forming the second resin layer 12 are tolylene diisocyanate (TDI), diphenylmethane diisocyanate (MDI) and p-phenylene diisocyanate (PPDI). This makes it possible to more reliably suppress the occurrence of cracks in the bottom part regions 18 of the water receiving parts.

The polyols for obtaining the urethane prepolymer having a terminal isocyanate group (NCO) are selected from polyether polyols and polyester polyols. Examples of polyether polyols include, for example, polyethylene glycol (PEG), polypropylene glycol (PPG), polytetramethylene glycol (PTMG), and the like. Examples of polyester polyols include, for example, polycaprolactone ester, polycarbonate, polyethylene adipate, polybutylene adipate, polyhexene adipate, and the like. These polyols may be used alone, or two or more may be mixed or polymerized together; modified products of these polyols may also be used.

Among what is described above, it is more preferable to use polytetramethylene glycol (PTMG) as polyol for forming the first resin layer 11.

Moreover, among what is described above, it is preferable to use polytetramethylene glycol (PTMG) as polyol for forming the second resin layer 12. Compared to polyester polyols, these polyols have excellent hydrolysis resistance.

Examples of curing agents having a terminal active hydrogen group (H) include, for example, aliphatic diol compounds, aromatic polyamine compounds, and the like. The aliphatic diol compounds are compounds selected from ethylene glycol, 1,3-propanediol, 1,4-butanediol, 1,5-pentanediol, 1,6-hexanediol, polyethylene glycol, polypropylene glycol, and polybutylene glycol, and the like. The aromatic polyamine compounds are compounds selected from methylene dianiline, 4,4'-methylene-bis-(3-chloro-2,6-diethylaniline), diethyl toluene diamine, 4,4'-methylene-bis-(2-ethyl-6-methyl-aniline), 4,4'-methylene-bis-(2-isopropyl-6-methyl-aniline), 4,4'-bis(2-butylamino) diphenylmethane, phenylene diamine, methylene-bis-(2-methylaniline), 4,4'-methylene-bis-(2-chloro-6-ethylaniline), (2-aminophenyl thiol) ethane, N,N'-dialkyl-p-phenylene diamine, 4,4'-methylene-bis (2,6-diisopropyl aniline), dimethylthiotoluenediamine, and the like. The above-mentioned curing agents may be used alone, or two or more may be mixed.

Among what is described above, it is preferable to use 1,4-butanediol or dimethylthiotoluenediamine as curing agent for forming the first resin layer 11. This makes it possible to more reliably suppress the occurrence of wear on the felt-side surface.

Moreover, among what is described above, it is preferable to use 1,4-butanediol or dimethylthiotoluenediamine as curing agent for forming the second resin layer 12. This makes it possible to more reliably suppress the occurrence of cracks in the bottom part regions 18 of the water receiving parts.

The first resin layer 11 can comprise polyurethane formed by using, for example, tolylene diisocyanate (TDI), diphenylmethane diisocyanate (MDI) or p-phenylene diisocyanate (PPDI) as phenylene isocyanate derivative, polytetramethylene glycol (PTMG) as polyol, and 1,4-butanediol or dimethylthiotoluenediamine as curing agent. In such cases, the equivalent ratio of the first resin layer 11 is preferably 0.80 to 1.15, more preferably 0.8 to 1.0, and even more preferably 0.80 to 0.99. This makes it possible to more reliably suppress the occurrence of wear on the felt-side surface.

The second resin layer 12 can comprise polyurethane formed by using, for example, tolylene diisocyanate (TDI), diphenylmethane diisocyanate (MDI) or p-phenylene diisocyanate (PPDI) as phenylene isocyanate derivative, polytetramethylene glycol (PTMG) as polyol, and 1,4-butanediol or dimethylthiotoluenediamine as curing agent. In such cases, the equivalent ratio of the second resin layer 12 is preferably 0.9 or more, and even more preferably 0.95 to 1.15. This makes it possible to more reliably suppress the occurrence of cracks in the bottom part regions 18 of the water receiving parts.

Furthermore, it is preferred that the constituting materials of the polyurethane constituting the first resin layer 11 and the constituting materials of the polyurethane constituting the second resin layer 12 have at least one or more types of material in common, and it is also preferred that all of the constituting materials are in common. More specifically, it is preferred that the curing agent and the urethane prepolymer constituting the first resin layer 11 and the second resin layer 12, respectively, are at least in part, or preferably in total, made from the same material. In particular, it is preferred to select the same material for the phenylene isocyanate derivative, the polyol and the curing agent of the first resin layer 11 and the second resin layer 12, respectively. Thus, it is possible to manufacture a shoe press belt, wherein the occurrence of wear in the felt-side surface can be suppressed more reliably and the occurrence of cracks in the bottom part regions 18 of the water receiving parts can be suppressed more reliably without imposing a manufacturing burden for the preparation and management of resins, in other words, without incurring manufacturing costs.

Moreover, the constituting material of the polyurethane constituting the first resin layer 11 or the second resin layer 12 may also comprise constituting materials that are not common to both layers, for example, a constituting material included in the first resin layer 11 which is not included in the second resin layer 12, and/or a constituting material included in the second resin layer 12 which is not included in the first resin layer 11. However, the content of such constituent materials that are not common to the different layers is preferably less than 10 wt %, or less than 5 wt % in the polyurethane constituting the first resin layer 11 or the second resin layer 12.

Moreover, in this way, it is possible to vary the equivalent value of the active hydrogen group (H) and the isocyanate group (NCO) in the first resin layer 11 and in the second resin layer 12 by changing the mixing ratio of the constituting materials in each layer, even when the constituting materials of the polyurethane constituting the first resin layer 11 are the same as the constituting materials of the polyurethane constituting the second resin layer 12. Specifically, for example, when each layer is formed, it is possible to obtain the desired equivalent ratio by suitably adjusting (selecting) the mixing ratio of the urethane prepolymer and the curing agent.

In the felt-side layer 15, water receiving parts (water discharge grooves 17 in FIG. 1) for receiving water squeezed from a wet paper web and a felt under a nip are formed from the felt-side surface in the depth direction. Here, the nip is a section in which the wet paper web 5 and the felt 4 are pressed by a press roll 2 and a shoe 6 in the papermaking shoe press device 1, as shown for example in FIG. 5. The water receiving parts 17 are recesses formed in the felt-side surface. Then, the water receiving parts 17 receive the water released when the felt 4 and the wet paper web 5 are pressed under the nip in the recesses. Meanwhile, the water receiving parts 17 discharge the water to the outside after passing the nip. In FIG. 1, a plurality of water discharge grooves 17 is arranged so as to be in parallel to the machine direction (MD) of the shoe press belt 3. These water receiving parts 17 may be arranged continuously or discontinuously in the machine direction (MD) or the cross-machine direction (CMD) of the shoe press belt 3. Moreover, FIG. 1 shows a rectangular cross-sectional shape of the water receiving parts 17, however, the cross-sectional shape of the water receiving parts 17 is not particularly limited; it can be U-shaped, trapezoidal, or the like; furthermore, the width and depth of the optionally selected cross-section are not particularly limited. For example, in the case of the water discharge grooves 17 shown in FIG. 1, the groove depth can be set from 0.5 mm to 2.0 mm, the groove width can be set from 0.5 mm to 1.5 mm, and the number of grooves can be set at 5 to 15 per inch.

The interface between the first resin layer 11 and the second resin layer 12 is arranged so that at least the bottom part regions 18 of the water discharge grooves 17 are included in the second resin layer. Thus, the wear resistance of the felt contacting surface is improved because the polyurethane of the first resin layer 11 has a low equivalent ratio; and the crack resistance and the resistance to crack growth in the bottom part regions 18 of the water discharge grooves 17 are improved because the polyurethane of the second resin layer 12 has a high equivalent ratio. The interface can be set at any position in relation to the depth direction of the water discharge grooves 17; however, for example, when the belt is used under conditions of significant wear of the felt contacting surface of the shoe press belt, the thickness of the first resin layer 11 can be made thick, in other words, the depth of the water receiving parts from the bottom part of the water receiving part cross-section is 70% or less, or 50% or less.

The position of the interface between the second resin layer 12 and the shoe-side layer 20 is not particularly limited. In FIG. 1 this interface is located at the upper part of the reinforcing base material 16, and the reinforcing base material 16 is embedded in the shoe-side layer. This interface may also be located in the inner part of the reinforcing base material 16; or at the lower part of the reinforcing base material 16, and the reinforcing base material 16 may be embedded in the felt-side layer 15. The thickness of the first resin layer 11, the second resin layer 12 and the shoe-side layer 20 of the shoe press belt 3 illustrated in FIG. 1 can be set between 0.2 to 1.8 mm, 0.2 to 4.0 mm and 1.0 to 4.0 mm, respectively.

Hereinafter one manufacturing example of the shoe press belt 3 shown in FIG. 1 will be explained. First, the surface of a mandrel is coated with a release agent and the reinforcing base material 16 is arranged to float from the mandrel surface, then a mixture of a urethane prepolymer and a curing agent is coated, impregnated and penetrated from the surface of the reinforcing base material 16, and pre-cured, so as to form the desired thickness of the shoe-side resin layer 21; thereby, the shoe-side layer 20, in which the reinforcing base material 16 is embedded in the shoe-side resin layer 21, is formed. In the case of this reinforcing base material 16 a resin of a relatively large permeation amount is used. Next, the second resin layer 12 is laminated onto the shoe-side layer 20 and pre-cured, the first resin layer 11 is further laminated onto the surface of the second resin layer 12 and post-cured; thereby, the reinforcing base material 16, the first resin layer 11, the second resin layer 12 and the shoe-side layer 20 are integrated. Finally, the felt contacting surface of the first resin layer 11 is polished and the water drainage grooves 17 are formed by a cutting process, or the like, and the shoe press belt 3 according to the mandrel manufacturing method is completed.

As another manufacturing example, first, the endless reinforcing base material 16 is stretched between two rolls arranged parallel to the axial direction, then a composition of a urethane prepolymer and a curing agent is coated, impregnated and laminated from the surface of the reinforcing material, and pre-cured. After reversing back and front, the belt is again stretched between the two rolls and a shoe-side layer 20 is formed in which the reinforcing base material is embedded in the shoe-side resin layer 21. In the case of this reinforcing base material 16 a resin of a relatively small permeation amount is used. Next, the second resin layer 12 is laminated onto the shoe-side layer 20 and pre-cured, the first resin layer 11 is further laminated onto the surface of the second resin layer 12 and post-cured; thereby, the reinforcing base material 16, the first resin layer 11, the second resin layer 12 and the shoe-side layer 20 are integrated. Finally, the felt contacting surface of the first resin layer 11 is polished and the water drainage grooves 17 are formed by a cutting process, or the like, and the shoe press belt 3 according to the two-roll manufacturing method is completed.

The curing conditions with both manufacturing methods are, pre-curing at 50 to 140° C. for 0.5 to 2 hours, and post-curing at 50 to 140° C. for 2 to 20 hours.

Figure 2:
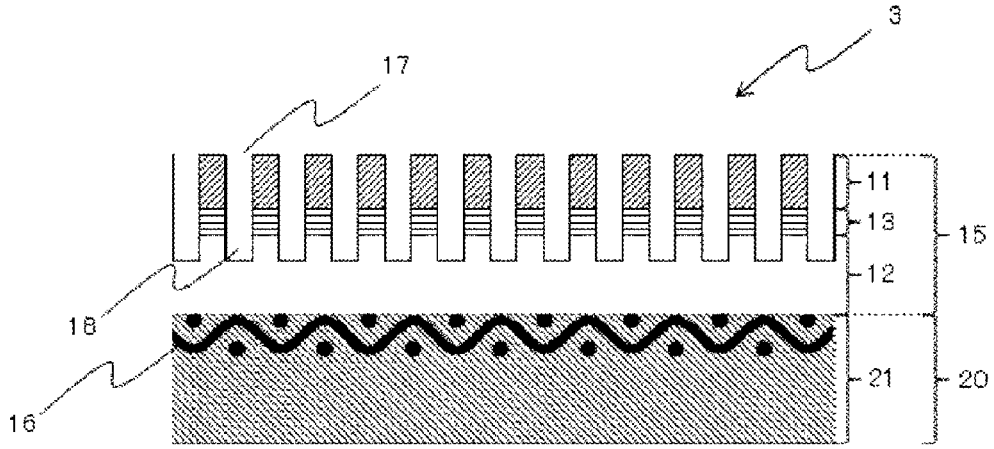
FIG. 2 is a partial cross-sectional view showing another example of a papermaking shoe press belt according to the present invention.

FIG. 2 is a partial cross-sectional view showing another example of the shoe press belt 3 of the present invention, wherein a third resin layer 13 is provided between the first resin layer 11 and the second resin layer 12 of the shoe press belt 3 shown in FIG. 1. Moreover, the third resin layer 13 may also be a layer of two or more layers.

Figure 3:
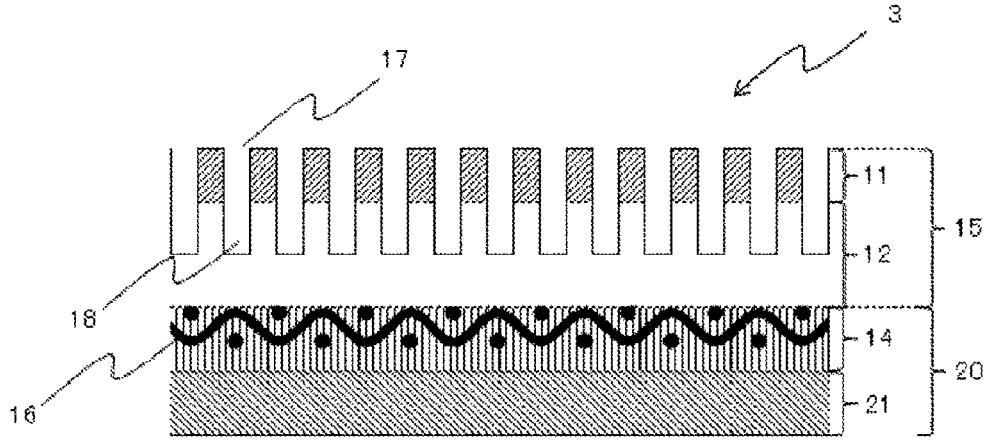
FIG. 3 is a partial cross-sectional view showing still another example of a papermaking shoe press belt according to the present invention.

FIG. 3 is a partial cross-sectional view showing still another example of a shoe press belt according to the present invention, wherein, with regard to the shoe-side layer 20 of the shoe press belt 3 shown in FIG. 1, the shoe-side resin layer 21 and a fourth resin layer 14 are provided. Moreover, the fourth resin layer 14 may also be a layer of two or more layers.

Urethane prepolymers made from phenylene isocyanate derivatives and polyols listed above and from a curing agent listed above can be used in the third resin layer 13 and the fourth resin layer 14 in the same way as in the first resin layer 11, the second resin layer 12 and the shoe-side resin layer 21; the equivalent ratio can be set at will.

Above, the present invention has been described in detail based on the embodiments shown in the drawings; however, the present invention is not limited to the embodiments described above. For example, the water receiving parts in embodiments shown in the drawings have been described as water drainage grooves; however, the water receiving parts may also be holes formed in the felt-side surface in the depth direction of the felt-side layer.

EXAMPLES

Examples 1 to 4, Comparative Example 1

The shoe press belt shown in FIG. 1 was prepared by the two-roll method.

The same type of woven fabric was used as reinforcing base material; and the polyurethane for the first resin layer, the second resin layer and the shoe-side layer was obtained by reacting a urethane prepolymer (NCO %=6.02) comprising tolylene diisocyanate (TDI) and polytetramethylene glycol (PTMG) with dimethylthiotoluenediamine (DMTDA). The equivalent ratios of the first resin layer and the second resin layer are as shown in Table 1, the layers were cured at 100° C. for 16 hours. The thickness of the first resin layer, the second resin layer and the shoe-side layer were 0.8 mm, 1.0 mm and 3.4 mm, respectively. The water discharge grooves had a groove width of 0.8 mm, a groove depth of 1.0 mm; the number of grooves was 10 grooves per inch.

TABLE 1

| | $1^{st}$ resin layer Equivalent ratio | $2^{nd}$ resin layer Equivalent ratio | Equivalent ratio difference | Relative wear rate | Time for cracks to occur (hours) |
|---|---|---|---|---|---|
| Example 1 | 0.80 | 1.15 | 0.35 | 5 | 19 |
| Example 2 | 0.95 | 1.05 | 0.10 | 55 | 16 |
| Example 3 | 0.98 | 1.02 | 0.04 | 88 | 13 |
| Example 4 | 0.99 | 1.01 | 0.02 | 95 | 12 |
| Comparative Example 1 | 1.00 | 1.00 | 0 | 100 | 11 |

Figure 4:
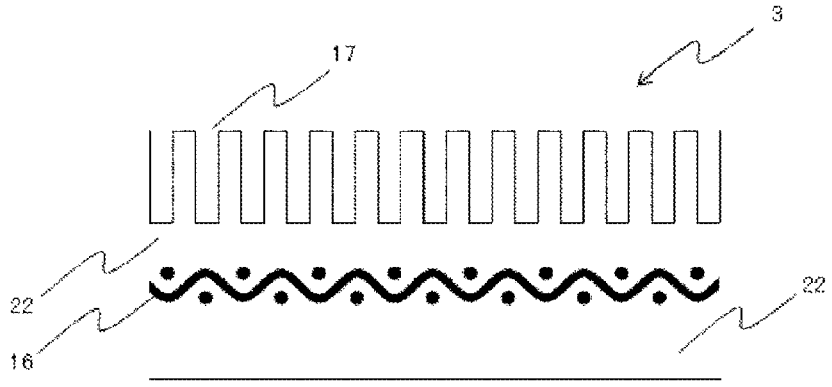
FIG. 4 is a partial cross-sectional view of a conventional papermaking shoe press belt.

Wear tests and flexural fatigue tests of the felt contacting surface were performed with the shoe press belts obtained. The device shown in FIG. 4 of JP 2006-144139 was used for the wear test; the belt sample was attached to the lower part of the press board, a rotating roll provided with a friction member at its outer circumference was pressed against the lower surface (the surface to be measured) of the belt sample while the roll was rotating. At this time, the pressure applied by the rotating roll was 6.6 kg/cm, the rotational speed of the rotational roll was 100 m/minute, the roll was rotated for 45 seconds. After the rotation, the amount of thickness reduction of the belt sample was measured (the relative wear amount by taking Comparative Example 1 as 100). The results are shown in Table 1.

Figure 6:
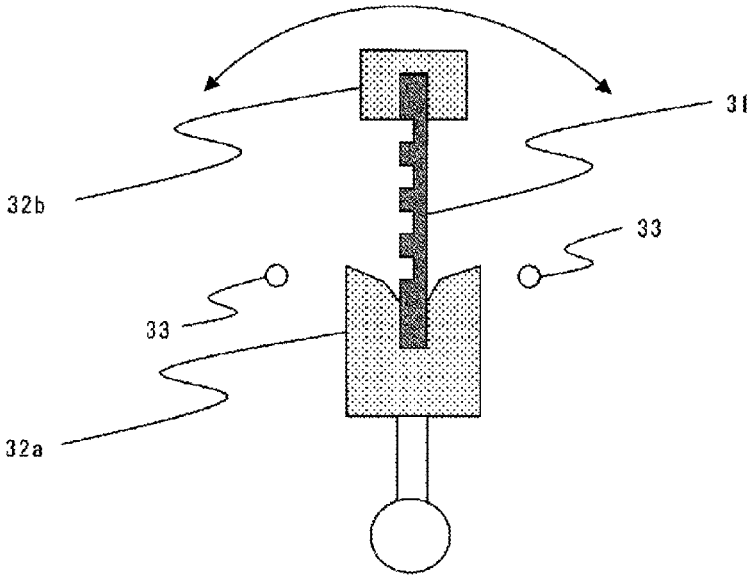
FIG. 6 is a schematic diagram of a flexural fatigue testing apparatus.

The flexural fatigue test was performed by using the device shown in FIG. 6; the test was performed at 20° C. and 52%) relative humidity under the conditions hereinafter to confirm whether or not cracks had occurred from the bottom part regions of the water discharge grooves. The test piece 31 was arranged with the water discharge grooves in parallel to the width direction, the test piece had a width of 60 mm and the length between the grips was 70 mm. By giving the lower grip tool 32 an arc-shaped back and forth movement, the upper grip tool and the test piece also moved back and forth in an arc-shape so that the test piece was bent and fatigued by the holding bar 33. The distance from the center of the arc to the front end of the lower grip tool was 168 mm, the moving distance of the lower part grip tool was 161 mm, and the speed was 162 back and forth movements per minute. The weight of the upper grip tool was 400 g. Bending was repeated under these conditions and the time until cracks occurred from the bottom part regions of the water discharge grooves was measured. The results are shown in Table 1.

As can be seen from Table 1, regarding the polyurethane equivalent value of the first resin layer comprising the felt contacting surface and the second resin layer comprising the bottom part regions of the water discharge grooves, by setting the equivalent value of the second resin layer at a higher value than the equivalent value of the first resin layer value, it was confirmed that the wear resistance of the felt contacting surface was improved and that the crack resistance of the bottom part regions of the water discharge grooves was improved.

DESCRIPTION OF THE REFERENCE CHARACTERS

1 Papermaking shoe press device
2 Press roll
3 Shoe press belt
4 Felt
5 Wet paper web
6 Shoe
11 The first resin layer

12 The second resin layer
13 The third resin layer
14 The fourth resin layer
15 Felt-side layer
16 Reinforcing base material
17 Water receiving parts (water discharge grooves)
18 Groove bottom part region
20 Shoe-side layer
21 Shoe-side resin layer
22 Thermosetting polyurethane
31 Shoe press belt test piece
32*a* Lower grip tool
32*b* Upper grip tool
33 Holding bar

The invention claimed is:

1. A papermaking shoe press belt, comprising:

at least a felt-side layer comprising a thermosetting polyurethane integrated with a reinforcing base material;

wherein:

in the felt-side layer, water receiving parts are formed in the depth direction from the felt-side surface for receiving water squeezed from a wet paper web and a felt under a nip;

the felt-side layer comprises at least a first resin layer comprising a felt-contacting surface and a second resin layer comprising bottom part regions of the water receiving parts;

the first resin layer and the second resin layer are formed from a composition comprising (i) a urethane prepolymer comprising a terminal isocyanate group, and (ii) a curing agent comprising dimethylthiotoluenediamine, wherein the urethane prepolymer of the first resin layer and the second resin layer are made from the same material; and the value of the equivalent ratio (H/NCO) of the active hydrogen group (H) of the dimethylthiotoluenediamine to the isocyanate group (NCO) of the urethane prepolymer is higher in the second resin layer than the value of the equivalent ratio (H/NCO) of the active hydrogen group (H) of the dimethylthiotoluenediamine to the isocyanate group (NCO) of the urethane prepolymer in the first resin layer.

2. The papermaking shoe press belt according to claim 1, wherein the water receiving parts are water discharge grooves.

3. The papermaking shoe press belt according to claim 1, wherein the difference between the equivalent ratio of the first resin layer and the equivalent ratio of the second resin layer is 0.02 or more.

4. The papermaking shoe press belt according to claim 1, wherein the difference between the equivalent ratio of the first resin layer and the equivalent ratio of the second resin layer is 0.04 or more.

5. The papermaking shoe press belt according to claim 1, wherein the equivalent ratio (H/NCO) of thermosetting polyurethane of the first resin layer is a value between 0.80 and 1.15.

6. The papermaking shoe press belt according to claim 1, wherein the equivalent ratio (H/NCO) of the thermosetting polyurethane of the first resin layer is a value between 0.80 and 0.99.

7. The papermaking shoe press belt according to claim 1, wherein the interface between the second resin layer and the resin layer adjacent to the second resin layer represents 10% or more of the depth of the water receiving parts from the bottom part of the water receiving part section.

* * * * *